US011472684B2

(12) United States Patent
Sato et al.

(10) Patent No.: US 11,472,684 B2
(45) Date of Patent: Oct. 18, 2022

(54) SAFETY DEVICE OF VEHICLE WITH AERIAL WORK PLATFORM

(71) Applicant: KABUSHIKI KAISHA AICHI CORPORATION, Saitama (JP)

(72) Inventors: Mitsuru Sato, Ageo (JP); Minoru Tano, Ageo (JP); Kou Yaegashi, Ageo (JP)

(73) Assignee: KABUSHIKI KAISHA AICHI CORPORATION, Saitama (JP)

( * ) Notice: Subject to any disclaimer, the term of this patent is extended or adjusted under 35 U.S.C. 154(b) by 459 days.

(21) Appl. No.: 16/811,485

(22) Filed: Mar. 6, 2020

(65) Prior Publication Data

US 2021/0276846 A1 Sep. 9, 2021

(51) Int. Cl.

| | |
|---|---|
| ***B66F 9/22*** | (2006.01) |
| ***B66F 11/04*** | (2006.01) |
| ***B66F 7/08*** | (2006.01) |
| ***E04G 1/22*** | (2006.01) |

(52) U.S. Cl.

CPC ..... *B66F 9/22* (2013.01); *B66F 11/042* (2013.01); *E04G 1/22* (2013.01); *B66F 7/08* (2013.01)

(58) Field of Classification Search

CPC ..... B66F 9/22; B66F 17/006; B66F 17/00; B66F 11/04; B66F 11/042

See application file for complete search history.

(56) References Cited

U.S. PATENT DOCUMENTS

| | | | | |
|---|---|---|---|---|
| 5,649,422 | A * | 7/1997 | Baginski | F15B 21/14 60/431 |
| 6,314,997 | B1 * | 11/2001 | Yamashita | B66F 9/22 137/596.13 |
| 2015/0013324 | A1 * | 1/2015 | Matsuo | F15B 21/14 60/459 |

FOREIGN PATENT DOCUMENTS

| | | | |
|---|---|---|---|
| JP | H01-106500 | U | 7/1989 |
| JP | 2000-229798 | A | 8/2000 |
| JP | 2008-156082 | A | 7/2008 |
| JP | 2008156082 | A * | 7/2008 |
| JP | 2019-210130 | A | 12/2019 |

OTHER PUBLICATIONS

An Office Action; "Notice of Reasons for Refusal", mailed by the Japanese Patent Office dated May 10, 2022, which corresponds to Japanese Patent Application No. 2018-110049 and is related to U.S. Appl. No. 16/811,485 with English language translation.

* cited by examiner

*Primary Examiner* — Tyrone V Hall, Jr.
(74) *Attorney, Agent, or Firm* — Studebaker & Brackett PC

(57) ABSTRACT

In a vehicle with aerial work platform, while not receiving an operation instruction to move down the work platform from the rise and fall operating device, when moving down of the work platform is detected based on the detecting result of the rise and fall position detecting device, the rise and fall control device controls the first switching valve to switch so that the bottom-side oil chamber is connected to the hydraulic pump and controls the second switching valve to switch to the first state so as to make oil pressure in the bottom-side oil chamber be kept by the second switching valve and the check valve. Then, the rise and fall hydraulic cylinder is stopped to be contracted.

4 Claims, 7 Drawing Sheets

FIG.4

| | RISE AND FALL CONTROL VALVE 72 | RISE AND FALL SWITCHING VALVE 76 |
|---|---|---|
| STOPPING BOTH RISE AND FALL | OFF | OFF |
| MOVING UP | ON | OFF |
| MOVING DOWN | OFF | ON |
| WHEN DETECTING NATURAL FALL | ON | OFF |

FIG. 6

| | RISE AND FALL CONTROL VALVE 172 | RISE AND FALL SWITCHING VALVE 176 |
|---|---|---|
| STOPPING BOTH RISE AND FALL | OFF | OFF |
| MOVING UP | ON | OFF |
| MOVING DOWN | ON | ON |
| WHEN DETECTING NATURAL FALL | OFF | OFF |

SAFETY DEVICE OF VEHICLE WITH AERIAL WORK PLATFORM

TECHNICAL FIELD

The present invention relates to a safety device of a vehicle with aerial work platform comprising a work platform that can move up and down by an elevating machine.

TECHNICAL BACKGROUND

A vehicle with aerial work platform is configured to comprise a traveling body that can travel, an elevating machine provided on the traveling body, and a work platform supported by the elevating machine. In such a vehicle with aerial work platform, the form of the traveling body is what is configured with a truck vehicle as the base or a self-propelled body comprising wheels or crawler mechanisms. Further, the form of the elevating machine is a boom type of machine that can turn, rise and fall, and extend and contract, or a vertical elevation type of machine comprising a scissors-link mechanism or a extending and contracting post, and various vehicles with aerial work platform having combinations of these forms of the traveling body and elevating machine are known. Almost any of these elevating machines is configured to comprise a hydraulic cylinder such that, by making the hydraulic cylinder extend and contract, the work platform is moved up and down (see, for example, Japanese Laid-Open Utility Model Publication No. H1-106500(U), Patent Document 1).

PROBLEMS TO BE SOLVED BY THE INVENTION

With a vehicle with aerial work platform as described above, there is the problem that, if a failure or the like in a control valve that controls the supply of hydraulic fluid to the hydraulic cylinder of the elevating machine occurs, the work platform falls naturally due to its own weight. Accordingly, the vehicle with aerial work platform described in Patent Document 1 is configured such that, when a natural fall of the work platform is detected, an electromagnetic shut-off valve is switched to stop the natural fall. However, supposing the case where some failure also occurs in this electromagnetic shut-off valve, it is necessary to double the safety function to stop the natural fall of the work platform.

SUMMARY OF THE INVENTION

In view of this problem, the present invention was made, and an object of the present invention is to provide a safety device of a vehicle with aerial work platform which can double the safety function to stop the natural fall of the work platform with cost increase being suppressed.

MEANS TO SOLVE THE PROBLEMS

In order to solve the above problem, the present invention is a safety device of a vehicle with aerial work platform which comprises a traveling body that can travel, an elevating machine provided on the traveling body, and a work platform supported by the elevating machine, and which is configured to be able to move up and down the work platform by extending and contracting a rise and fall hydraulic cylinder (e.g., an elevating cylinder 21 in embodiments) which is a part of the elevating machine. The safety device of the vehicle with aerial work platform comprises a hydraulic pump that discharges hydraulic fluid to be supplied to the rise and fall hydraulic cylinder; a first switching valve (e.g., a rise and fall control valve 72 in embodiments) that switches a bottom-side oil chamber of the rise and fall hydraulic cylinder between being connected to the hydraulic pump and being connected to an hydraulic fluid reservoir; a second switching valve (e.g., a rise and fall switching valve 76 in embodiments) provided in a line leading from the first switching valve to the bottom-side oil chamber of the rise and fall hydraulic cylinder and that switches between a first state of allowing an hydraulic fluid flow from the first switching valve side to the bottom-side oil chamber side while blocking a flow in an opposite direction and a second state of allowing both the flows; a check valve (e.g., a first check valve 73 in embodiments) provided in a line leading from the hydraulic pump to the first switching valve and that allows an hydraulic fluid flow from the hydraulic pump side to the first switching valve side while blocking a flow in an opposite direction; a rise and fall control device (e.g., a rise and fall control section 53 of a controller 50 in embodiments) that controls the first switching valve and the second switching valve to switch according to an operation instruction from a rise and fall operating device (e.g., a rise and fall operating lever 43 in embodiments) so as to make the rise and fall hydraulic cylinder extend and contract; and a rise and fall position detecting device (e.g., a rise and fall position detector 61 in embodiments) that detects a rise and fall position of the work platform. And the safety device is configured such that, while not receiving an operation instruction to move down the work platform from the rise and fall operating device, when detecting the work platform moving down based on the detecting result of the rise and fall position detecting device, the rise and fall control device controls the first switching valve to switch so that the bottom-side oil chamber is connected to the hydraulic pump and controls the second switching valve to switch to the first state so as to make oil pressure in the bottom-side oil chamber be kept by the second switching valve and the check valve, thereby stopping the rise and fall hydraulic cylinder contracting.

In the safety device having the above configuration, the rise and fall control device may be configured such that, when receiving an operation instruction to move up the work platform from the rise and fall operating device, the control device controls the first switching valve to switch so that the bottom-side oil chamber is connected to the hydraulic pump and controls the second switching valve to switch to the first state so as to supply hydraulic fluid from the hydraulic pump to the bottom-side oil chamber to make the rise and fall hydraulic cylinder extend.

In the safety device having the above configuration, the rise and fall control device may be configured such that, when receiving an operation instruction to move down the work platform from the rise and fall operating device, the control device controls the first switching valve to switch so that the bottom-side oil chamber is connected to the hydraulic fluid reservoir and controls the second switching valve to switch to the second state so as to allow oil pressure in the bottom-side oil chamber to decrease due to the weight of the work platform to make the rise and fall hydraulic cylinder contract.

In the safety device having the above configuration, the rise and fall control device may be configured such that, when not receiving an operation instruction from the rise and fall operating device, the control device controls the first switching valve to switch so that the bottom-side oil chamber is connected to the hydraulic fluid reservoir and controls the second switching valve to switch to the first state so as to make oil pressure in the bottom-side oil chamber be kept by the second switching valve.

ADVANTAGEOUS EFFECTS OF THE INVENTION

The safety device of the vehicle with aerial work platform according to the present invention is configured to, when the natural fall of the work platform is detected, control the first switching valve to switch so that the bottom-side oil chamber of the rise and fall hydraulic cylinder is connected to the hydraulic pump and to control the second switching valve to switch to the first state of blocking an hydraulic fluid flow from the bottom-side oil chamber side to the first switching valve side so as to make oil pressure in the bottom-side oil chamber be kept by the second switching valve and the check valve provided upstream of the first switching valve (on the primary side), thereby stopping the rise and fall hydraulic cylinder contracting. As such, when the natural fall of the work platform is detected, the natural fall of the work platform can be stopped by two check valves, using not only the first switching valve (a switching check valve) provided on the rise and fall hydraulic cylinder side but also the check valve provided on the hydraulic pump side. Because the check valve provided on the hydraulic pump side has conventionally been provided to prevent a reverse flow to the hydraulic pump, the safety function of stopping the natural fall of the work platform can be doubled with cost increase being suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTIONS OF THE DRAWINGS

The present invention will become more fully understood from the detailed description given herein below and the accompanying drawings which are given by way of illustration only and thus are not limitative of the present invention.

FIG. 4 is a table showing switching control of each valve when a work platform of the vehicle with aerial work platform is moved up and down.

FIG. 6 is a table showing switching control of each valve in the second embodiment.

DESCRIPTION OF THE EMBODIMENTS

Figure 1:
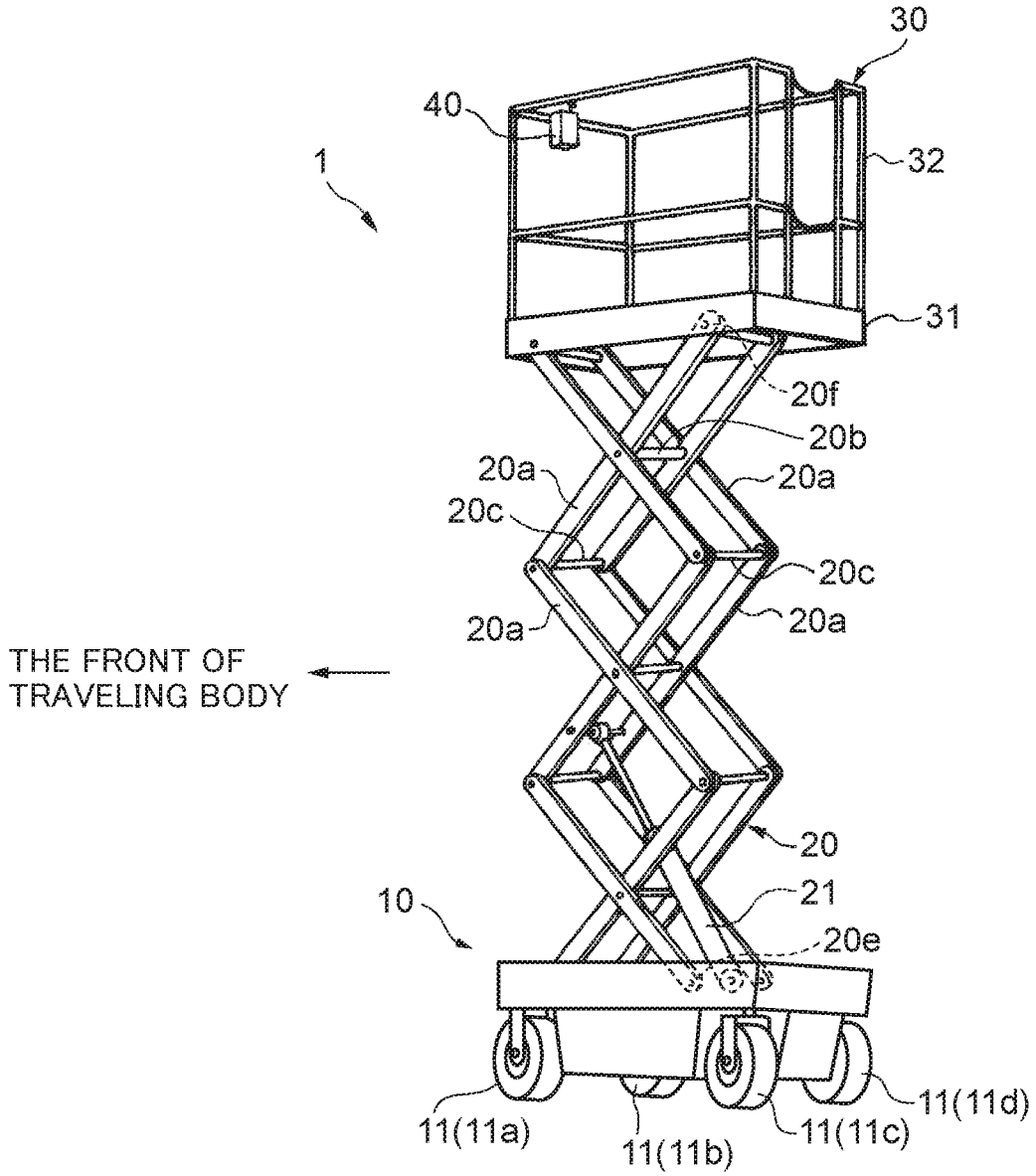
FIG. 1 is a perspective view of a vehicle with aerial work platform comprising a safety device according to the present invention.

Embodiments of the present invention will be described below with reference to the drawings. FIG. 1 shows an example vehicle with aerial work platform comprising a safety device according to the present invention. This vehicle with aerial work platform 1 is configured to comprise a traveling body 10 having four tire wheels 11 provided on the front and rear, and right and left thereof, an elevating machine 20 provided on the top of the traveling body 10, and a work platform 30 supported by this elevating machine 20.

The traveling body 10 has right and left traveling motors 12*a*, 12*b* (see FIG. 2) to rotationally drive a pair of right and left front wheels 11*a*, 11*b* from among the tire wheels 11 respectively, a turning mechanism (not shown) linking the right and left front wheels 11*a*, 11*b*, and a steering cylinder 17 (see FIG. 2) to drive the turning mechanism to change the rudder angle of the right and left front wheels 11*a*, 11*b* (the deflection angle with respect to the front-to-back center axis of the traveling body 10). From among the tire wheels 11, a pair of right and left rear wheels 11*c*, 1*d* are non-driven wheels linked by an axle. The traveling body 10 is configured to drive rotationally the right and left front wheels 11*a*, 11*b* by the right and left traveling motors 12*a*, 12*b* while changing the rudder angle of the right and left front wheels 11*a*, 11*b* by the steering cylinder 17 so as to be able to travel in a desired direction.

The elevating machine 20 is configured to have a scissors-link mechanism configured such that sets of two link members 20*a* in an X shape are provided in parallel apart transversely of the traveling body 10 with the middle parts of the sets of two link members 20*a* being linked by a first pivot joint rod 20*b* and that further three stages of the sets of two link members 20*a* stacked vertically are pivotally coupled to each other by second pivot joint rods 20*c*, and an elevating cylinder 21 provided across between this scissors-link mechanism and the traveling body 10.

The lowermost link members 20*a* forming part of the scissors-link mechanism have their lower ends on the front side of the traveling body 10 pivotally coupled to the top of the traveling body 10 and rollers 20*e* provided at their lower ends on the rear side of the traveling body 10 to roll on rails provided on the top of the traveling body 10. The uppermost link members 20*a* forming part of the scissors-link mechanism have their upper ends on the front side of the traveling body 10 pivotally coupled to the bottom of the work platform 30 and rollers 20*f* provided at their upper ends on the rear side of the traveling body 10 to roll along rails provided on the bottom of the work platform 30. The elevating machine 20 is configured to be able to make the scissors-link mechanism vertically extend and contract to move the work platform 30 up and down vertically by making the elevating cylinder 21 extend and contract.

Figure 2:
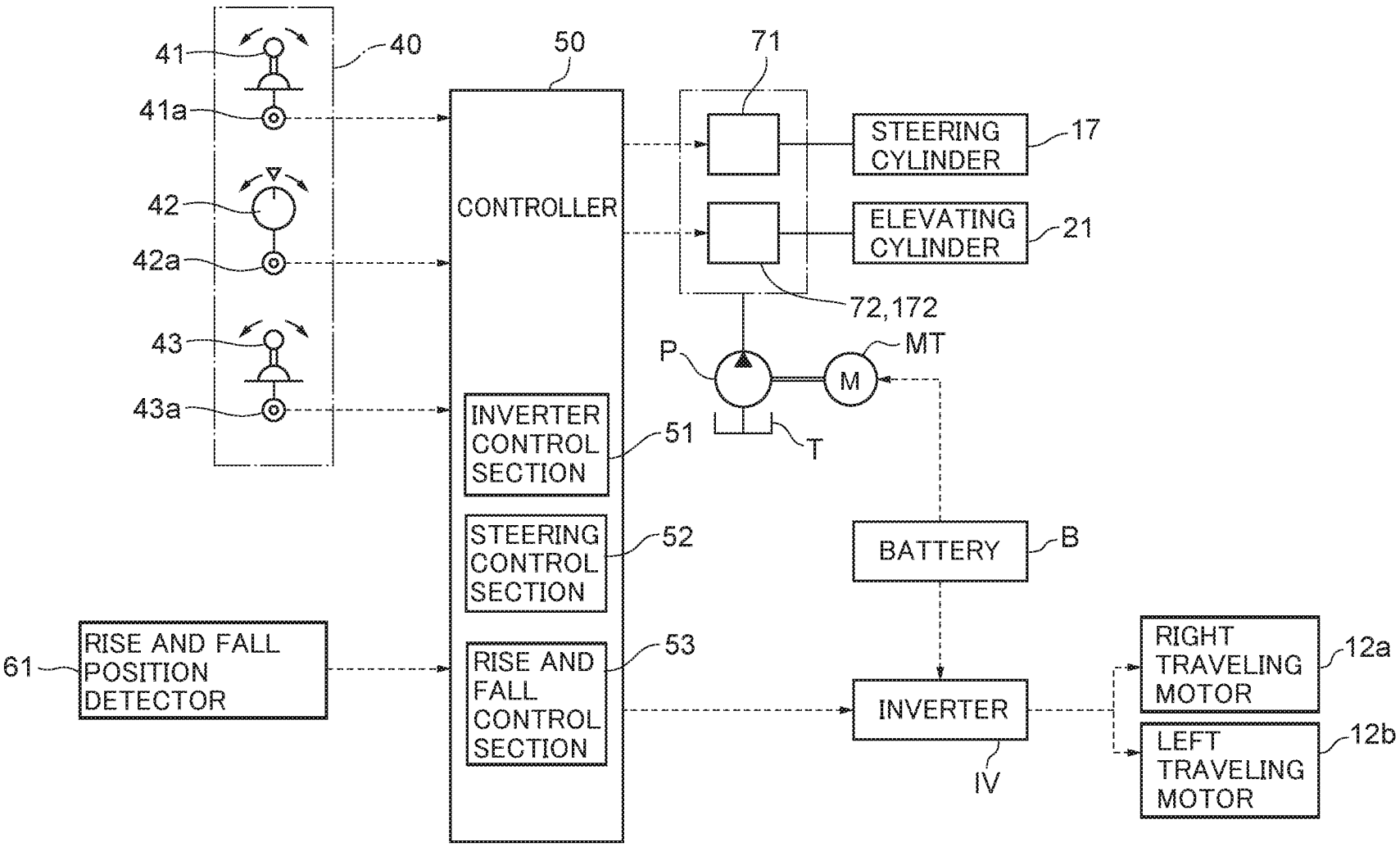
FIG. 2 is a block diagram showing the working control configuration of the vehicle with aerial work platform.

The work platform 30 has a work floor 31 which a worker can get aboard, guardrails 32 provided standing on the front, rear, right, and left edges of the work floor 31, and an operating device 40 provided on the top of the guardrail 32 on the front side. The operating device 40 has, as shown in FIG. 2, a travel operating lever 41 with which to perform travel operation for the traveling body to start moving, to stop, and to move forward and backward, a steering dial 42 with which to steer the traveling body 10 (to steer the right and left front wheels 11*a*, 11*b* that are steered wheels), and a rise and fall operating lever 43 with which to operate the work platform 30 to rise and fall. The vehicle with aerial work platform 1 is configured such that a worker, being aboard the work platform 30, by operating the travel operating lever 41, the steering dial 42, and the rise and fall operating lever 43, can make the traveling body 10 travel and make the work platform 30 rise and fall so as to move to a desired work position.

The travel operating lever 41 is configured to be located in a neutral position where it is in a vertical attitude when not being operated and to be able to be inclined forward and backward with respect to this neutral position. The state of the travel operating lever 41 being operated (the operation direction and operation amount with respect to the neutral position) is detected by a travel operation detector 41*a* constituted by a potentiometer or the like provided in the operating device 40, and the detection signal is inputted to a controller 50. The operation of inclining the travel operating lever 41 forward corresponds to an instruction to make the traveling body 10 travel forward, and as the inclination operation amount thereof becomes greater, the controller 50 sets the target speed when traveling forward at a greater value. The operation of inclining the travel operating lever 41 backward corresponds to an instruction to make the traveling body 10 travel backward, and as the inclination operation amount thereof becomes greater, the controller sets the target speed when traveling backward at a greater value. The operation of returning the travel operating lever 41 to the neutral position corresponds to an instruction to make the traveling body 10 stop.

The steering dial 42 is configured to be located in a neutral position (such a position that a mark drawn on the steering dial 42 coincides with a mark drawn on the surface of the operating device 40 as shown in FIG. 2) when not being operated and to be able to be twisted to the right (clockwise) and to the left (counterclockwise) with respect to this neutral position. The state of the steering dial 42 being operated (the operation direction and operation amount with respect to the neutral position) is detected by a steering operation detector 42*a* constituted by a potentiometer or the like provided in the operating device 40, and the detection signal is inputted to the controller 50. The operation of twisting the steering dial 42 to the right corresponds to an instruction to steer the front wheels 11*a*, 11*b* to the right, and as the twist operation amount thereof becomes greater, the controller 50 sets the rightward target rudder angle at a greater value. The operation of twisting the steering dial 42 to the left corresponds to an instruction to steer the front wheels 11*a*, 11*b* to the left, and as the twist operation amount thereof becomes greater, the controller 50 sets the leftward target rudder angle at a greater value. Further, the operation of returning the steering dial 42 to the neutral position corresponds to an instruction to make the rudder angle of the front wheels 11*a*, 1*b* be zero (an instruction to make the traveling body 10 travel straight).

The rise and fall operating lever 43 is configured to be located in a neutral position where it is in a vertical attitude when not being operated and to be able to be inclined forward and backward with respect to this neutral position. The state of the rise and fall operating lever 43 being operated (the operation direction and operation amount with respect to the neutral position) is detected by a rise and fall operation detector 43*a* constituted by a potentiometer or the like provided in the operating device 40, and the detection signal is inputted to the controller 50. The operation of inclining the rise and fall operating lever 43 forward corresponds to an instruction to lower the work platform 30, and the operation of inclining the rise and fall operating lever 43 backward corresponds to an instruction to raise the work platform 30. Further, the operation of returning the rise and fall operating lever 43 to the neutral position corresponds to an instruction to stop the work platform 30.

In the traveling body 10, there are provided a battery B and an inverter IV to convert direct-current power from the battery B into alternating-current power so as to supply to the right and left traveling motors 12*a*, 12*b*. An inverter control section 51 of the controller 50 supplies electric power to the right and left traveling motors 12*a*, 12*b* via the inverter IV such that the right and left traveling motors 12*a*, 12*b* rotationally drive in the rotational direction and at the rotational speed according to the state of the travel operating lever 41 being operated, so as to control the right and left traveling motors 12*a*, 12*b* to drive rotationally.

Further, the traveling body 10 comprises a pump driving motor MT to drive rotationally by power from the battery B, a hydraulic pump P driven by the pump driving motor MT, an hydraulic fluid reservoir T, a steering control valve 71 to switch the supply direction of hydraulic fluid to the steering cylinder 17, and a rise and fall control valve 72 to switch the supply direction (including whether to supply or not) of hydraulic fluid to the elevating cylinder 21. The pump driving motor MT is driven rotationally only when operating the work platform 30 to rise via the rise and fall operating lever 43 and when performing steering operation via the steering dial 42. Hydraulic fluid discharged from the hydraulic pump P is supplied to the steering cylinder 17 via the steering control valve 71 and to the elevating cylinder 21 via the rise and fall control valve 72.

A steering control section 52 of the controller 50 performs control to drive electromagnetically the spool of the steering control valve 71 according to the operation of the steering dial 42 to switch the supply direction of hydraulic fluid to the steering cylinder 17 so as to make the steering cylinder 17 extend and contract, thereby changing the rudder angle of the right and left front wheels 11*a*, 11*b*. A rise and fall control section 53 of the controller 50 performs control to drive electromagnetically the spool of the rise and fall control valve 72 according to the operation of the rise and fall operating lever 43 to switch the supply direction of hydraulic fluid to the elevating cylinder 21 so as to make the elevating cylinder 21 extend and contract, thereby moving up and down the work platform 30 by the elevating machine 20.

The elevating machine 20 comprises a rise and fall position detector 61 to detect the rise and fall position (height position) of the work platform 30 from the extension amount of the elevating cylinder 21. The rise and fall position information of the work platform 30 detected by the rise and fall position detector 61 is inputted to the rise and fall control section 53 of the controller 50. Note that the rise and fall position detector 61 may be constituted by an optical or ultrasonic reflection distance sensor to detect the rise and fall position of the work platform 30 instead of having the configuration for detecting the rise and fall position of the work platform 30 from the extension amount of the elevating cylinder 21.

The vehicle with aerial work platform 1 configured as above comprises a safety device which stops the natural fall of the work platform 30 when a failure occurs in which the work platform 30 moves down due to the weights of the work platform 30 and the like in spite of the rise and fall operating lever 43 not being operated. This safety device will be described using a diagram of a hydraulic circuit, shown in FIG. 3, that operates the elevating cylinder 21 and steering cylinder 17 to extend and contract.

Figure 3:
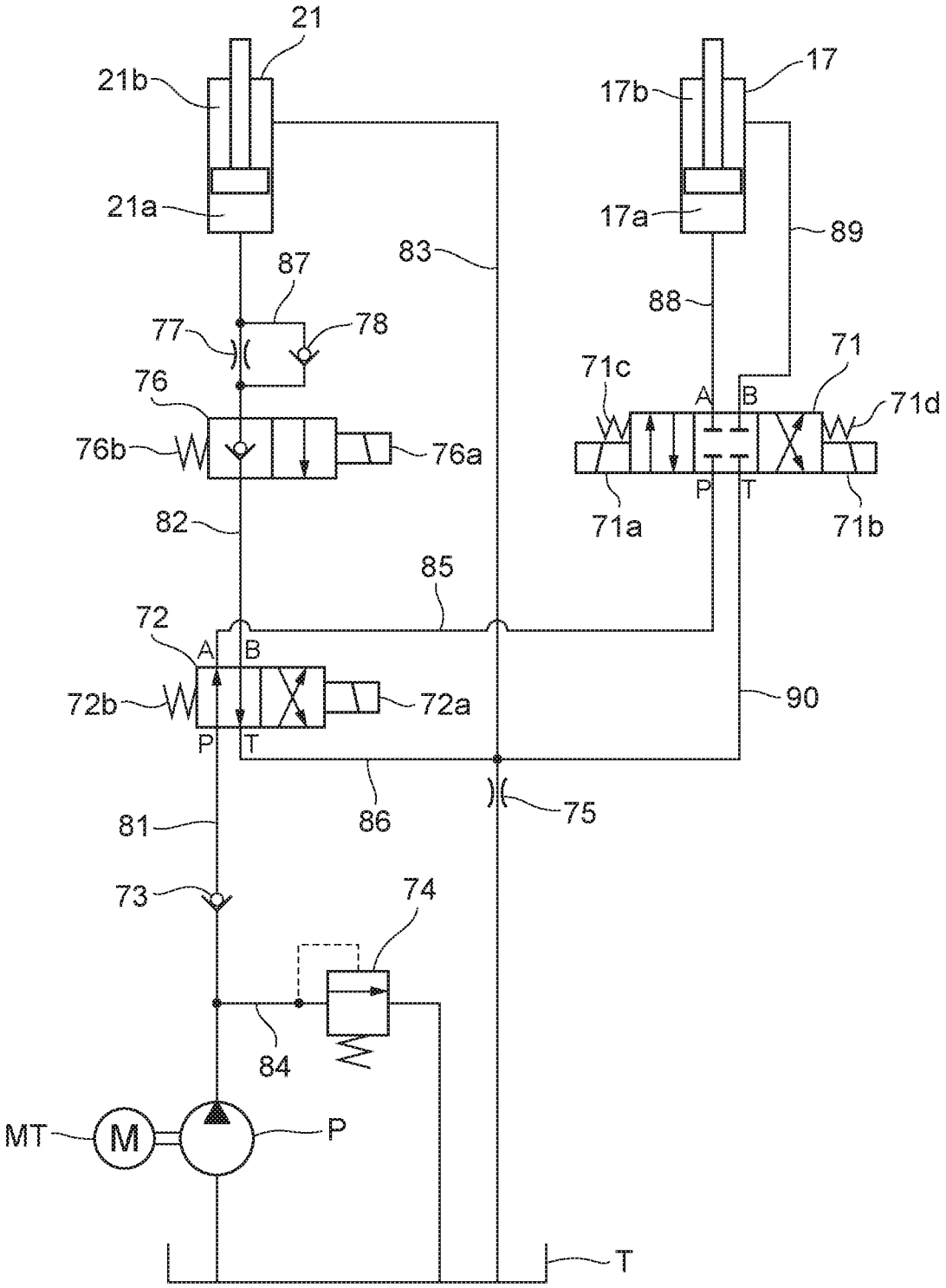
FIG. 3 is a hydraulic circuit diagram showing the configuration of a circuit to hydraulically drive an elevating cylinder provided in the vehicle with aerial work platform.

This hydraulic circuit comprises, as shown in FIG. 3, a pump line 81 linking the hydraulic pump P and the rise and fall control valve 72, a rise and fall bottom-side line 82 linking the rise and fall control valve 72 and a rise and fall bottom-side oil chamber 21*a* of the elevating cylinder 21, and a rise and fall rod-side line 83 linking a rise and fall rod-side oil chamber 21*b* of the elevating cylinder 21 and the hydraulic fluid reservoir T. In the pump line 81, there is provided a first check valve 73 that allows an hydraulic fluid flow from the hydraulic pump P side to the rise and fall control valve 72 side while blocking an hydraulic fluid flow in an opposite direction (from the rise and fall control valve 72 side to the hydraulic pump P side). In the pump line 81, there is provided a branch line 84 branching off at a position upstream (on the hydraulic pump P side) of the first check valve 73 and leading to the hydraulic fluid reservoir T, and a relief valve 74 is provided in the branch line 84.

The rise and fall control valve 72 is a four-port, two-position electromagnetic switching valve; the pump line 81 is connected to its P port; a first reservoir line 86 leading to the hydraulic fluid reservoir T is connected to its T port; a steering supply line 85 leading to the steering control valve 71 is connected to its A port; and the rise and fall bottom-side line 82 is connected to its B port. When a solenoid 72*a* is unexcited (an OFF state), with its spool being pushed by a spring 72*b*, the rise and fall control valve 72 is switched to an OFF position shown in FIG. 3, so that the P port is connected to the A port while the B port is connected to the T port and that hydraulic fluid from the hydraulic pump P is supplied to the steering control valve 71 via the steering supply line 85. Further, when the solenoid 72*a* is excited by a control signal from the rise and fall control section 53 of the controller 50 (when in an ON state), with its spool being pushed by the solenoid 72*a* against the pushing force of the spring 72*b*, the rise and fall control valve 72 is switched to an ON position, so that the P port is connected to the B port while the A port is connected to the T port and that hydraulic fluid from the hydraulic pump P is supplied to the rise and fall bottom-side oil chamber 21*a* of the elevating cylinder 21 via the rise and fall bottom-side line 82 to make the elevating cylinder 21 extend.

The first reservoir line 86 is joined to the rise and fall rod-side line 83 and leads to the hydraulic fluid reservoir T. In the rise and fall rod-side line 83, a first restrictor valve 75 to secure predetermined oil pressure in the rise and fall rod-side oil chamber 21*b* of the elevating cylinder 21 is provided at a position downstream (on the hydraulic fluid reservoir T side) of the meeting point with the first reservoir line 86.

A rise and fall switching valve 76 is provided in the rise and fall bottom-side line 82. The rise and fall switching valve 76 is a two-port, two-position electromagnetic switching check valve and, when a solenoid 76*a* is unexcited (the OFF state), with its spool being pushed by a spring 76*b*, is switched to the OFF position shown in FIG. 3 so as to allow an hydraulic fluid flow from the rise and fall control valve 72 side to the rise and fall bottom-side oil chamber 21*a* side of the elevating cylinder 21 while blocking an hydraulic fluid flow in an opposite direction (from the rise and fall bottom-side oil chamber 21*a* side to the rise and fall control valve 72 side). Further, when the solenoid 76*a* is excited by a control signal from the rise and fall control section 53 of the controller 50 (when in the ON state), with its spool being pushed by the solenoid 76*a* against the pushing force of the spring 76*b*, the rise and fall switching valve 76 is switched to the ON position so as to allow hydraulic fluid flows in both the directions in the rise and fall bottom-side line 82.

In the rise and fall bottom-side line 82, a second restrictor valve 77 and a second check valve 78 are provided at a position downstream (on the rise and fall bottom-side oil chamber 21*a* side) of the rise and fall switching valve 76. The second restrictor valve 77 limits the amount of oil discharged from the rise and fall bottom-side oil chamber 21*a* to control the fall speed of the work platform (the contraction speed of the elevating cylinder 21). The second check valve 78 is configured to allow an hydraulic fluid flow from the rise and fall switching valve 76 side to the rise and fall bottom-side oil chamber 21*a* side while blocking an hydraulic fluid flow in an opposite direction (from the rise and fall bottom-side oil chamber 21*a* side to the rise and fall switching valve 76 side).

The steering control valve 71 is a four-port, three-position electromagnetic switching valve; the steering supply line 85 is connected to its P port; a second reservoir line 90 leading to the hydraulic fluid reservoir T is connected to its T port; a steering bottom-side line 88 leading to the steering bottom-side oil chamber 17*a* of the steering cylinder 17 is connected to its A port; and the steering rod-side line 89 leading to the steering rod-side oil chamber 17*b* of the steering cylinder 17 is connected to its B port. The second reservoir line 90 is joined to the rise and fall rod-side line 83 at the same position as the meeting point with the first reservoir line 86 in the rise and fall rod-side line 83 and leads to the hydraulic fluid reservoir T. When left and right solenoids 71*a*, 71*b* are unexcited, with its spools being pushed by springs 71*c*, 71*d*, the steering control valve 71 is switched to the OFF position shown in FIG. 3, so that all the P, T, A and B ports are blocked.

Further, when the left solenoid 71*a* is excited by a control signal from the steering control section 52 of the controller 50, with its spool being pushed by the solenoid 71*a* against the pushing force of the right spring 71*d*, the steering control valve 71 is switched to a left position, so that the P port is connected to the A port while the B port is connected to the T port and that hydraulic fluid from the hydraulic pump P is supplied to the steering bottom-side oil chamber 17*a* of the steering cylinder 17 via the steering bottom-side line 88 to make the steering cylinder 17 extend. Further, when the right solenoid 71*b* is excited, with its spool being pushed by the solenoid 71*b* against the pushing force of the left spring 71*c*, the steering control valve 71 is switched to a right position, so that the P port is connected to the B port while the A port is connected to the T port and that hydraulic fluid from the hydraulic pump P is supplied to the steering rod-side oil chamber 17*b* of the steering cylinder 17 via the steering rod-side line 89 to make the steering cylinder 17 contract.

In the hydraulic circuit having the above configuration, the working of each valve when making the elevating cylinder 21 extend and contract for the elevating machine 20 to move up and down the work platform 30 will be described with reference to FIGS. 2 to 4. When the operation of inclining backward the rise and fall operating lever 43 to move up the work platform 30 is performed, the rise and fall control section 53 of the controller 50 sends out a control signal to the rise and fall control valve 72. Then the solenoid 72*a* of the rise and fall control valve 72 is excited to switch the rise and fall control valve 72 to the ON position so that hydraulic fluid from the hydraulic pump P is supplied to the rise and fall bottom-side line 82. At this time, the rise and fall control section 53 does not send out a control signal to the rise and fall switching valve 76. Hence, the solenoid 76*a* of the rise and fall switching valve 76 becomes unexcited, so that the rise and fall switching valve 76 goes into the OFF position state of allowing an hydraulic fluid flow from the rise and fall control valve 72 side to the rise and fall bottom-side oil chamber 21*a* side. Thus, hydraulic fluid from the hydraulic pump P is supplied through the rise and fall bottom-side line 82 and the rise and fall switching valve 76 to the rise and fall bottom-side oil chamber 21*a* of the elevating cylinder 21, so that the elevating cylinder 21 extends for the work platform 30 to move up by the elevating machine 20. Note that, only when operating the work platform 30 to rise via the rise and fall operating lever 43 and when performing steering operation via the steering dial 42, the pump driving motor MT is driven rotationally so as to drive the hydraulic pump P.

Then, when the rise and fall operating lever 43 is returned to the neutral position, the rise and fall control section 53 of the controller 50 stops sending out the control signal to the rise and fall control valve 72. When sending out the control signal is stopped, the solenoid 72*a* of the rise and fall control valve 72 becomes unexcited so that the rise and fall control valve 72 goes into the OFF position state where the pump line 81 is connected to the steering supply line 85. At this time, a control signal is not sent out to the rise and fall switching valve 76 either, and the rise and fall switching valve 76 remains in the OFF position state. Thus, the supply of hydraulic fluid to the rise and fall bottom-side oil chamber 21*a* of the elevating cylinder 21 is stopped so that the elevating cylinder 21 stops extending and that the work platform 30 stops moving up by the elevating machine 20. Since the rise and fall switching valve 76 remains in the OFF position state, the hydraulic fluid flow in a discharge direction from the rise and fall bottom-side oil chamber 21*a* is blocked by the rise and fall switching valve 76. Therefore, because oil pressure in the rise and fall bottom-side oil chamber 21*a* is kept, the elevating cylinder 21 is stopped from contracting due to the weights of the work platform 30 and the like so that the height position of the work platform 30 is maintained.

When the operation of inclining forward the rise and fall operating lever 43 to move down the work platform 30 is performed, the rise and fall control section 53 of the controller 50 sends out a control signal to the rise and fall switching valve 76. Then the solenoid 76*a* of the rise and fall switching valve 76 is excited to switch the rise and fall switching valve 76 to the ON position so as to allow the hydraulic fluid flow in a discharge direction from the rise and fall bottom-side oil chamber 21*a* of the elevating cylinder 21. At this time, the rise and fall control section 53 does not send out a control signal to the rise and fall control valve 72. Hence, the solenoid 72*a* of the rise and fall control valve 72 becomes unexcited, so that the rise and fall control valve 72 goes into the OFF position state where the rise and fall bottom-side line is connected to the first reservoir line 86. Thus, since the elevating cylinder 21 is receiving the force of a contraction direction due to the weight of the work platform 30 and the like, hydraulic fluid in the rise and fall bottom-side oil chamber 21*a* is discharged through the rise and fall bottom-side line 82, the rise and fall switching valve 76, the rise and fall control valve 72, and the first reservoir line 86 to the hydraulic fluid reservoir T, so that the elevating cylinder 21 contracts and that the work platform 30 moves down by the elevating machine 20.

As above, when the rise and fall operating lever 43 is located in the neutral position (when the rise and fall operating lever 43 is not being operated), usually the rise and fall control valve 72 and the rise and fall switching valve 76 are both in the OFF position state, so that the elevating cylinder 21 extending and contracting is stopped and that the height position of the work platform 30 is maintained by the elevating machine 20. However, it can be thought that, if a failure in the valves or the like occurs, the elevating cylinder 21 may contract due to the weights of the work platform 30 and the like for the work platform to fall naturally.

Accordingly, while the rise and fall operating lever 43 is located in the neutral position (when the rise and fall operating lever 43 is not being operated), when the rise and fall position detector 61 detects the work platform 30 moving down, the rise and fall control section 53 of the controller 50 transmits a control signal to the rise and fall control valve 72. Then the solenoid 72*a* of the rise and fall control valve 72 is excited to switch the rise and fall control valve 72 to the ON position so that the rise and fall bottom-side line 82 is connected to the pump line 81. At this time, the rise and fall control section 53 does not send out a control signal to the rise and fall switching valve 76. Hence, the solenoid 76*a* of the rise and fall switching valve 76 becomes unexcited, so that the rise and fall switching valve 76 goes into the OFF position state of blocking the hydraulic fluid flow in a discharge direction from the rise and fall bottom-side oil chamber 21*a*. Thus, the flow of hydraulic fluid discharged from the rise and fall bottom-side oil chamber 21*a* of the elevating cylinder 21 is blocked by the rise and fall switching valve 76 and blocked also by the first check valve 73 provided in the pump line 81. Therefore, oil pressure in the rise and fall bottom-side oil chamber 21*a* is kept by the rise and fall switching valve 76 and the first check valve 73, the elevating cylinder 21 is stopped from contracting due to the weights of the work platform 30 and the like so as to stop the natural fall of the work platform 30. At this time, since the rise and fall operating lever 43 is located in the neutral position, the pump driving motor MT is not driven rotationally, and the hydraulic pump P is not driven either.

As such, when the natural fall of the work platform 30 is detected, the natural fall of the work platform 30 can be stopped by two check valves, using not only the rise and fall switching valve 76 (switching check valve) provided on the elevating cylinder 21 side but also the first check valve 73 provided on the hydraulic pump P side. Because the first check valve 73 provided on the hydraulic pump P side has conventionally been provided to prevent a reverse flow to the hydraulic pump P, the safety function of stopping the natural fall of the work platform 30 can be doubled with cost increase being suppressed.

Next, a second embodiment of the safety function of stopping the natural fall of the work platform 30 will be described with reference to FIG. 5. The same reference numerals are used to denote the same components as in the above embodiment, with description thereof being omitted.

Figure 5:
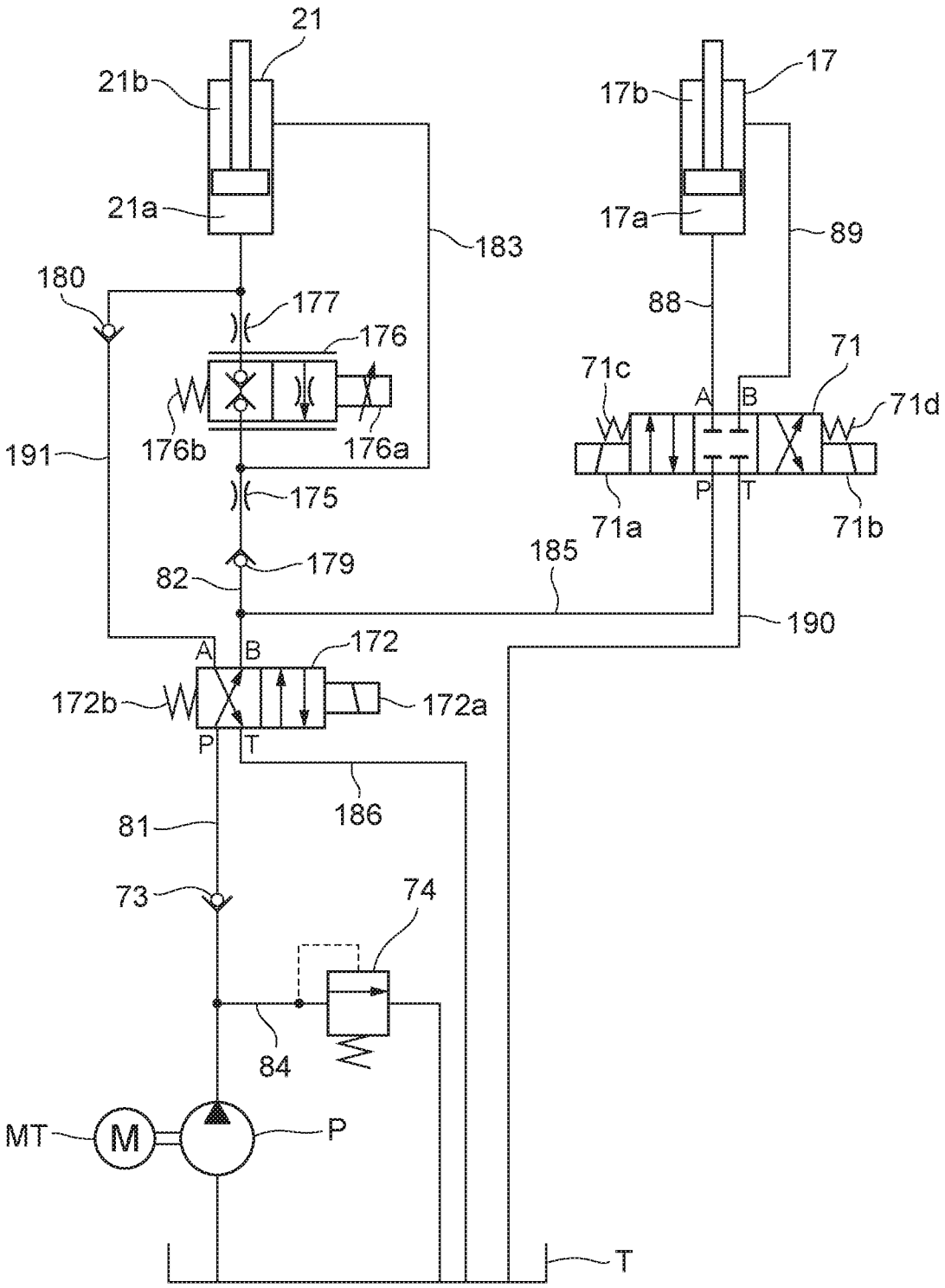
FIG. 5 is a hydraulic circuit diagram showing the configuration of a hydraulic circuit of an elevating cylinder according to a second embodiment.

This hydraulic circuit comprises, as shown in FIG. 5, a pump line 81 linking the hydraulic pump P and a rise and fall control valve 172 and a rise and fall bottom-side line 82 linking the rise and fall control valve 172 and the rise and fall bottom-side oil chamber 21*a* of the elevating cylinder 21. A rise and fall rod-side line 183 extending from the rise and fall rod-side oil chamber 21*b* of the elevating cylinder 21 is connected to a position (on the rise and fall control valve 172 side) on the upstream side of the rise and fall bottom-side line 82.

In the rise and fall bottom-side line 82, at a position upstream of the connection with the rise and fall rod-side line 183, there is provided a first restrictor valve 175 for securing predetermined oil pressure in the rise and fall rod-side oil chamber 21*b* of the elevating cylinder 21. Further, at a position upstream of the first restrictor valve 175, there is provided a second check valve 179 that allows an hydraulic fluid flow from the elevating cylinder 21 side to the rise and fall control valve 172 side while blocking an hydraulic fluid flow in an opposite direction (from the rise and fall control valve 172 side to the elevating cylinder 21 side). Yet further, in the rise and fall bottom-side line 82, there is provided a steering supply line 185 branching off at a position upstream of the second check valve 179 and leading to the steering control valve 71.

The rise and fall control valve 172 is a four-port, two-position electromagnetic switching valve; the pump line 81 is connected to its P port; a first reservoir line 186 leading to the hydraulic fluid reservoir T is connected to its T port; a rise and fall supply line 191 connected to a position (on the elevating cylinder 21 side) on the downstream side of the rise and fall bottom-side line 82 is connected to its A port; and the rise and fall bottom-side line 82 is connected to its B port. When a solenoid 172*a* is unexcited (an OFF state), with its spool being pushed by a spring 172*b*, the rise and fall control valve 172 is switched to an OFF position shown in FIG. 5, so that the P port is connected to the B port while the A port is connected to the T port and that hydraulic fluid from the hydraulic pump P is supplied to the steering control valve via a steering supply line 185. Further, when the solenoid 172*a* is excited by a control signal from the rise and fall control section 53 of the controller 50 (when in an ON state), with its spool being pushed by the solenoid 172*a* against the pushing force of the spring 172*b*, the rise and fall control valve 172 is switched to an ON position, so that the P port is connected to the A port while the B port is connected to the T port and that hydraulic fluid from the hydraulic pump P is supplied to the rise and fall bottom-side oil chamber 21*a* of the elevating cylinder 21 via the rise and fall supply line 191 and the rise and fall bottom-side line 82 to make the elevating cylinder 21 extend.

In the rise and fall supply line 191, there is provided a third check valve 180 that allows an hydraulic fluid flow from the rise and fall control valve 172 side to the rise and fall bottom-side oil chamber 21*a* of the elevating cylinder 21 while blocking an hydraulic fluid flow in an opposite direction (from the rise and fall bottom-side oil chamber 21*a* side to the rise and fall control valve 172 side).

In the rise and fall bottom-side line 82, at a position between the connection with the rise and fall supply line 191 and the connection with the rise and fall rod-side line 183, there are provided a second restrictor valve 177 and a rise and fall switching valve 176. The second restrictor valve 177 limits the amount of oil discharged from the rise and fall bottom-side oil chamber 21*a* to control the fall speed of the work platform 30 (the contraction speed of the elevating cylinder 21). The rise and fall switching valve 176 is a two-port, two-position electromagnetic proportional switching check valve and, when a solenoid 176*a* is unexcited (the OFF state), with its spool being pushed by a spring 176*b*, is switched to the OFF position shown in FIG. 5, so that hydraulic fluid flows in both the directions in the rise and fall bottom-side line 82 are blocked. Further, when the solenoid 176*a* is excited by a control signal from the rise and fall control section 53 of the controller 50 (when in the ON state), with its spool being pushed by the solenoid 176*a* against the pushing force of the spring 176*b*, the rise and fall switching valve 176 is switched to an ON position to allow hydraulic fluid flows in both the directions in the rise and fall bottom-side line 82 (while proportionally controlling the flow rate).

As to the steering control valve 71, the steering supply line 185 is connected to its P port, and a second reservoir line 190 leading to the hydraulic fluid reservoir T is connected to its T port.

In the hydraulic circuit having the above configuration, the working of each valve when making the elevating cylinder 21 extend and contract for the elevating machine 20 to move up and down the work platform 30 will be described with reference to FIGS. 5 and 6. When the operation of inclining backward the rise and fall operating lever 43 to move up the work platform 30 is performed, the rise and fall control section 53 of the controller 50 sends out a control signal to the rise and fall control valve 172. Then the solenoid 172*a* of the rise and fall control valve 172 is excited to switch the rise and fall control valve 172 to the ON position so that hydraulic fluid from the hydraulic pump P is supplied to the rise and fall supply line 191. At this time, the rise and fall control section 53 does not send out a control signal to the rise and fall switching valve 176. Hence, the solenoid 176*a* of the rise and fall switching valve 176 becomes unexcited, so that the rise and fall switching valve 176 goes into the OFF position state of preventing hydraulic fluid flowing from the rise and fall supply line 191 into the rise and fall bottom-side line 82 from flowing to the rise and fall control valve 172 side. Thus, hydraulic fluid from the hydraulic pump P is supplied through the rise and fall supply line 191 to the rise and fall bottom-side oil chamber 21*a* of the elevating cylinder 21, so that the elevating cylinder 21 extends for the work platform 30 to move up by the elevating machine 20. Note that, only when operating the work platform 30 to rise via the rise and fall operating lever 43 and when performing steering operation via the steering dial 42, the pump driving motor MT is driven rotationally so as to drive the hydraulic pump P.

Then, when the rise and fall operating lever 43 is returned to the neutral position, the rise and fall control section 53 of the controller 50 stops sending out the control signal to the rise and fall control valve 172. When sending out the control signal is stopped, the solenoid 172*a* of the rise and fall control valve 172 becomes unexcited so that the rise and fall control valve 172 goes into the OFF position state where the pump line 81 is connected to the steering supply line 185. At this time, a control signal is not sent out to the rise and fall switching valve 176 either, and the rise and fall switching valve 176 remains in the OFF position state. Thus, the supply of hydraulic fluid to the rise and fall bottom-side oil chamber 21*a* of the elevating cylinder 21 is stopped so that the elevating cylinder 21 stops extending and that the work platform 30 stops moving up by the elevating machine 20. Since the rise and fall switching valve 176 remains in the OFF position state, the hydraulic fluid flow in a discharge direction from the rise and fall bottom-side oil chamber 21*a* is blocked by the rise and fall switching valve 176 and the third check valve 180 in the rise and fall supply line 191. Therefore, because oil pressure in the rise and fall bottom-side oil chamber 21*a* is kept, the elevating cylinder 21 is stopped from contracting due to the weights of the work platform 30 and the like so that the height position of the work platform 30 is maintained.

When the operation of inclining forward the rise and fall operating lever 43 to move down the work platform 30 is performed, the rise and fall control section 53 of the controller 50 sends out a control signal to the rise and fall control valve 172 and the rise and fall switching valve 176. Then the solenoid 172*a* of the rise and fall control valve 172 is excited to switch the rise and fall control valve 172 to the ON position so that the rise and fall bottom-side line 82 is connected to the first reservoir line 186. Further, the solenoid 176*a* of the rise and fall switching valve 176 is excited to switch the rise and fall switching valve 176 to the ON position so as to allow the hydraulic fluid flow in a discharge direction from the rise and fall bottom-side oil chamber 21*a* of the elevating cylinder 21. Thus, since the elevating cylinder 21 is receiving the force of a contraction direction due to the weight of the work platform 30 and the like, hydraulic fluid in the rise and fall bottom-side oil chamber 21*a* is discharged through the rise and fall bottom-side line 82, the rise and fall switching valve 176, the rise and fall control valve 172, and the first reservoir line 186 to the hydraulic fluid reservoir T, so that the elevating cylinder 21 contracts and that the work platform 30 moves down by the elevating machine 20. At this time, since operating the work platform 30 to move down via the rise and fall operating lever 43 is being performed, the pump driving motor MT is not driven rotationally, and the hydraulic pump P is not driven either.

As above, when the rise and fall operating lever 43 is located in the neutral position (when the rise and fall operating lever 43 is not being operated), the rise and fall control valve 172 and the rise and fall switching valve 176 are both in the OFF position state, so that the elevating cylinder 21 extending and contracting is stopped and that the height position of the work platform 30 is maintained by the elevating machine 20. Here, if the natural fall of the work platform 30 occurs due to a failure in the valves or the like, the working of each valve is controlled as follows.

While the rise and fall operating lever 43 is located in the neutral position (when the rise and fall operating lever 43 is not being operated), when the rise and fall position detector 61 detects the work platform 30 moving down, the rise and fall control section 53 of the controller 50 does not send out a control signal to the rise and fall control valve 172 and the rise and fall switching valve 176, so that the rise and fall control valve 172 and the rise and fall switching valve 176 are both kept in the OFF position state. Hence, the solenoid 172*a* of the rise and fall control valve 172 becomes unexcited so that the rise and fall control valve 172 connects the rise and fall bottom-side line 82 to the pump line 81. Further, the solenoid 176*a* of the rise and fall switching valve 176 becomes unexcited so that the rise and fall switching valve 176 blocks the hydraulic fluid flow in a discharge direction from the rise and fall bottom-side oil chamber 21*a*. Thus, the flow of hydraulic fluid discharged from the rise and fall bottom-side oil chamber 21*a* of the elevating cylinder 21 is blocked by the rise and fall switching valve 176 and blocked also by the first check valve 73 provided in the pump line 81. Further, the flow of hydraulic fluid discharged from the rise and fall bottom-side oil chamber 21*a* and flowing into the rise and fall supply line 191 is blocked by the third check valve 180. Therefore, since oil pressure in the rise and fall bottom-side oil chamber 21*a* is kept by the rise and fall switching valve 176, the first check valve 73, and the third check valve 180, the elevating cylinder 21 is stopped from contracting due to the weights of the work platform 30 and the like so as to stop the natural fall of the work platform 30. At this time, since the rise and fall operating lever 43 is located in the neutral position, the pump driving motor MT is not driven rotationally, and the hydraulic pump P is not driven either.

As such, when the natural fall of the work platform 30 is detected, the natural fall of the work platform 30 can be stopped using not only the rise and fall switching valve 176 (a switching check valve) provided on the elevating cylinder 21 side and the third check valve 180 but also the first check valve 73 provided on the hydraulic pump P side. Further, if the rise and fall position detector 61 continues detecting the work platform 30 moving down due to a failure in the third check valve 180, the rise and fall control section 53 of the controller 50 can send out a control signal to the rise and fall control valve 172 to switch the rise and fall control valve 172 to the ON position so as to connect the rise and fall supply line 191 and the pump line 81, so that the natural fall of the work platform 30 can be stopped using the first check valve 73. Because the first check valve 73 provided on the hydraulic pump P side has conventionally been provided to prevent a reverse flow to the hydraulic pump P, the safety function of stopping the natural fall of the work platform 30 can be doubled with cost increase being suppressed.

Figure 7:
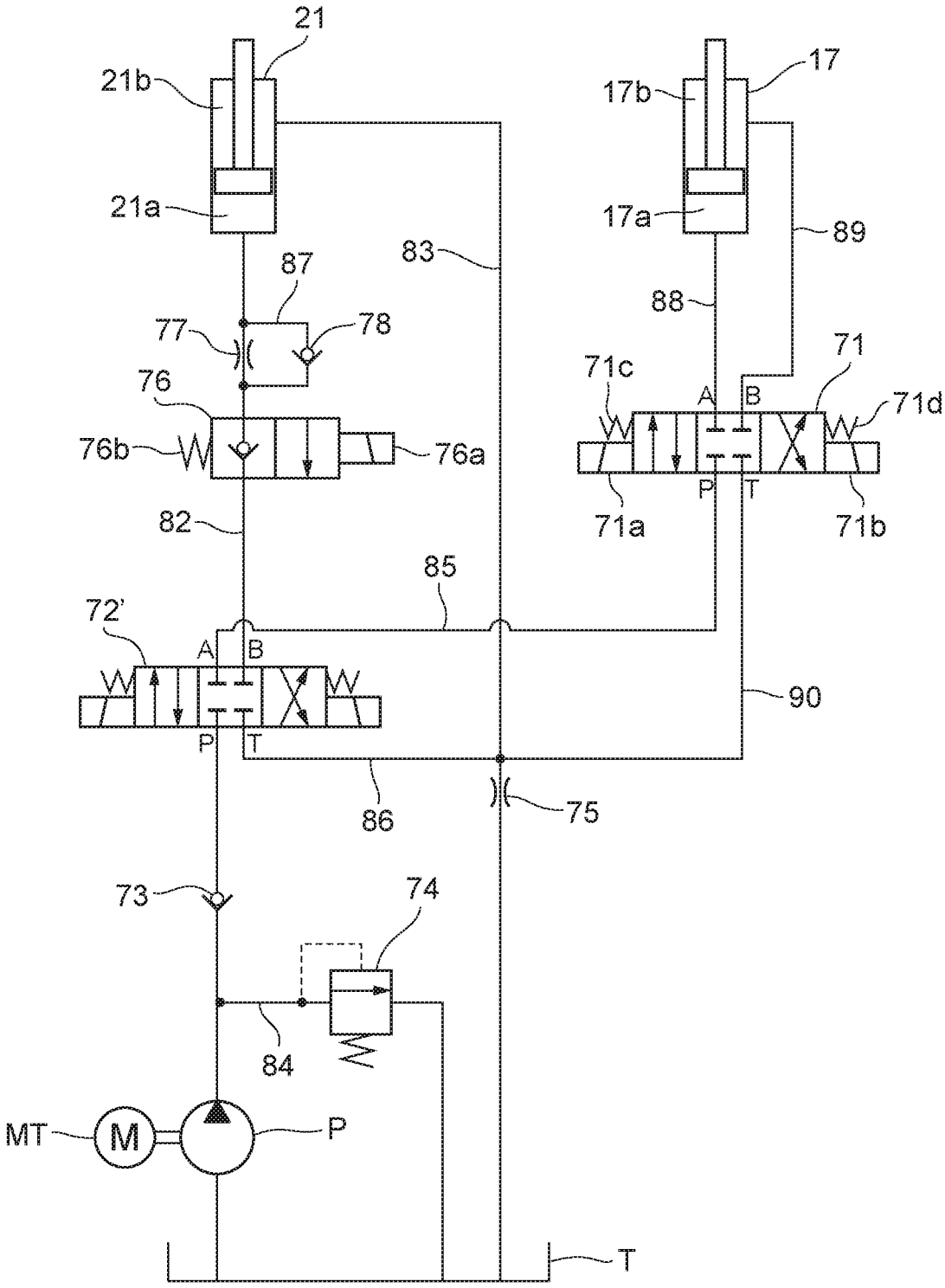
FIG. 7 is a hydraulic circuit diagram showing a modified example configuration of the hydraulic circuit of the elevating cylinder shown in FIG. 3.

Although embodiments according to the present invention have been described so far, the scope of the present invention is not limited to that shown in the above embodiments. For example, although in the above embodiments the rise and fall control valve 72 is a four-port, two-position electromagnetic switching valve, the rise and fall control valve 72 may be replaced with a rise and fall control valve 72' that is a four-port, three-position electromagnetic switching valve as shown in FIG. 7. Although the above embodiments describe an example where the safety device according to the present invention is applied to a self-propelled vehicle with aerial work platform comprising a scissors-link mechanism elevating machine, not being limited to this, the present invention can be applied to various vehicles with aerial work platform comprising an elevating machine of, e.g., a vertical mast type, boom type, or the like to obtain the same action effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A safety device of a vehicle with aerial work platform which comprises a traveling body that can travel, an elevating machine provided on the traveling body, and a work platform supported by the elevating machine, and which is configured to be able to move up and down the work platform by extending and contracting a rise and fall hydraulic cylinder which is a part of the elevating machine, comprising:

a hydraulic pump that discharges hydraulic fluid to be supplied to the rise and fall hydraulic cylinder;

a first switching valve that switches a bottom-side oil chamber of the rise and fall hydraulic cylinder between being connected to the hydraulic pump and being connected to an hydraulic fluid reservoir;

a second switching valve provided in a line leading from the first switching valve to the bottom-side oil chamber of the rise and fall hydraulic cylinder and that switches between a first state of allowing an hydraulic fluid flow from the first switching valve side to the bottom-side oil chamber side while blocking a flow in an opposite direction and a second state of allowing both the flows;

a check valve provided in a line leading from the hydraulic pump to the first switching valve and that allows an hydraulic fluid flow from the hydraulic pump side to the first switching valve side while blocking a flow in an opposite direction;

a rise and fall control device that controls the first switching valve and the second switching valve to switch according to an operation instruction from a rise and fall operating device so as to make the rise and fall hydraulic cylinder extend and contract; and a rise and fall position detecting device that detects a rise and fall position of the work platform, wherein while not receiving an operation instruction to move down the work platform from the rise and fall operating device, when detecting the work platform moving down based on the detecting result of the rise and fall position detecting device, the rise and fall control device controls the first switching valve to switch so that the bottom-side oil chamber is connected to the hydraulic pump and controls the second switching valve to switch to the first state so as to make oil pressure in the bottom-side oil chamber be kept by the second switching valve and the check valve, thereby stopping the rise and fall hydraulic cylinder contracting.

2. The safety device of the vehicle with aerial work platform according to claim 1, wherein when receiving an operation instruction to move up the work platform from the rise and fall operating device, the rise and fall control device controls the first switching valve to switch so that the bottom-side oil chamber is connected to the hydraulic pump and controls the second switching valve to switch to the first state so as to supply hydraulic fluid from the hydraulic pump to the bottom-side oil chamber to make the rise and fall hydraulic cylinder extend.

3. The safety device of the vehicle with aerial work platform according to claim 1, wherein when receiving an operation instruction to move down the work platform from the rise and fall operating device, the rise and fall control device controls the first switching valve to switch so that the bottom-side oil chamber is connected to the hydraulic fluid reservoir and controls the second switching valve to switch to the second state so as to allow oil pressure in the bottom-side oil chamber to decrease due to the weight of the work platform to make the rise and fall hydraulic cylinder contract.

4. The safety device of the vehicle with aerial work platform according to claim 1, wherein when not receiving an operation instruction from the rise and fall operating device, the rise and fall control device controls the first switching valve to switch so that the bottom-side oil chamber is connected to the hydraulic fluid reservoir and controls the second switching valve to switch to the first state so as to make oil pressure in the bottom-side oil chamber be kept by the second switching valve.

* * * * *